US008940075B2

(12) United States Patent
Hwang et al.

(10) Patent No.: US 8,940,075 B2
(45) Date of Patent: Jan. 27, 2015

(54) METHOD FOR FABRICATING FINE REDUCED IRON POWDERS

(75) Inventors: Kuen-Shyang Hwang, Taipei (TW); Ching-Yu Chen, Taoyuan County (TW); Yung-Chung Lu, Taoyuan County (TW)

(73) Assignee: Taiwan Powder Technologies Co., Ltd., Dasi Township, Taiyuan County (TW)

( * ) Notice: Subject to any disclaimer, the term of this patent is extended or adjusted under 35 U.S.C. 154(b) by 337 days.

(21) Appl. No.: 13/439,118

(22) Filed: Apr. 4, 2012

(65) Prior Publication Data

US 2013/0263698 A1 Oct. 10, 2013

(51) Int. Cl.
*B22F 9/04* (2006.01)
*B22F 9/22* (2006.01)

(52) U.S. Cl.
CPC .... *B22F 9/04* (2013.01); *B22F 9/22* (2013.01)
USPC ..... 75/342; 75/348; 75/356; 419/26

(58) Field of Classification Search
None
See application file for complete search history.

(56) References Cited

U.S. PATENT DOCUMENTS

| | | | | |
|---|---|---|---|---|
| 4,400,337 | A * | 8/1983 | Hayashi et al. | 264/82 |
| 4,420,332 | A * | 12/1983 | Mori et al. | 75/449 |
| 4,652,305 | A | 3/1987 | Ebenhoech et al. | |
| 6,375,103 | B1 | 4/2002 | Huang et al. | |
| 6,443,376 | B1 | 9/2002 | Huang et al. | |
| 2011/0162484 | A1 | 7/2011 | Steiner et al. | |

* cited by examiner

*Primary Examiner* — George Wyszomierski
(74) *Attorney, Agent, or Firm* — Muncy, Geissler, Olds & Lowe, P.C.

(57) ABSTRACT

A method for fabricating fine reduced iron powders comprises the following steps: heating fine iron oxide powders having a mean particle size of smaller than 20 μm to a reduction temperature of over 700° C. to reduce the fine iron oxide powder into iron powders that are partially sintered into iron powder agglomerates; and performing a crushing-spheroidizing process on the iron powder agglomerates to obtain individual iron powders having a mean particle size of smaller than 20 μm. The method can reduce iron oxide powers into iron powders having a rounded shape and a high packing density and a high tap density, which are suitable for the metal injection molding process and the inductor fabrication process. The reduced iron powder may further be processed using an annealing process and a second crushing-spheroidizing process in sequence to further increase the sphericity, packing density, and tap density of the reduced iron powder.

10 Claims, 5 Drawing Sheets

METHOD FOR FABRICATING FINE REDUCED IRON POWDERS

FIELD OF THE INVENTION

The present invention relates to a method for fabricating fine and rounded reduced iron powders, particularly to a method for fabricating fine reduced iron powders suitable for the MIM process and the inductor fabrication process.

BACKGROUND OF THE INVENTION

The MIM (Metal Injection Molding) process and the inductor fabrication process require iron powders having a small particle size and a specific shape. Preferably, the size is smaller than 20 μm, and the shape is nearly spherical. The current methods of producing iron powders include millscale reduction, magnetite powder reduction, gas atomization, water atomization, electrolysis, and carbonyl decomposition. The iron powders produced using millscale reduction, magnetite powder reduction, gas atomization, and water atomization methods have a coarse mean particle size (normally greater than 20 μm). Although smaller particles can be screened from the abovementioned iron powders, only a small proportion of sufficiently small particles can be obtained from the abovementioned iron powder. Therefore, these methods are costly. The electrolysis method can produce iron powders having a smaller particle size. However, these particles have a dendritic shape. Thus, this iron powder has a low packing density and poor flowability. In contrast, the carbonyl decomposition method can fabricate carbonyl iron powders featuring a small particle size (about 2-10 μm), high packing density, spherical shape, high purity, and superior sinterability. Furthermore, the carbonyl decomposition method can be used to mass-produce iron powders. Therefore, the carbonyl decomposition method is usually used for fabricating iron powders for the MIM process and the inductor fabrication process.

As for the conventional carbonyl decomposition method, U.S. Pat. No. 4,652,305 and No. US2011/0162484 disclosed an iron powder fabrication method, which comprises a high-pressure synthesis process and a thermal decomposition process. Firstly, sponge iron powders or reduced iron powders are reacted with carbon monoxide under a high pressure to form gaseous iron pentacarbonyl ($Fe(CO)_5$). Next, the pressure and temperature are decreased, and the gaseous iron pentacarbonyl becomes liquid iron pentacarbonyl. Then the iron pentacarbonyl is gasified and thermally decomposed to carbonyl iron powders.

The advantages of the carbonyl iron powder include spherical shape, high packing density, small particle size, superior sinterability, and capability of mass production. However, the fabrication process thereof is complicated and has safety concerns due to the colorless, odorless, and toxic carbon monoxide involved. The fabrication of carbonyl iron powder also requires high temperatures and high-pressure equipment, airtight thermal decomposition devices, and safety-protection facilities. For these reasons, the capital investment and technical challenges of fabricating carbonyl iron powders are very high for the user. Since the user commonly lacks facilities to fabricate the powder, the user has to pay a very high price to purchase it on the market.

SUMMARY OF THE INVENTION

The primary objective of the present invention is to overcome the problems of complexity and high cost of the conventional technologies of fabricating iron powders for the MIM process and the inductor fabrication process.

To achieve the abovementioned objective, the present invention proposes a method for fabricating fine reduced iron powders, which comprises the steps of: heating fine iron oxide powders containing over 98 wt % iron oxide and having a mean particle size smaller than 20 μm to a temperature of over 700° C. in a reducing atmosphere to reduce the fine iron oxide powders into iron powder agglomerates with the iron particles partially sintered; after the partially sintered iron powder agglomerates cool to room temperature, a crushing-spheroidizing process is applied to crush the iron powder agglomerates and to spheroidize the particles thereof into a rounded shape and a mean particle size of smaller than 20 μm.

The present invention also proposes a method for fabricating fine reduced iron powders, which comprises the steps of: heating a fine iron oxide powder containing over 98 wt % iron oxide and having a mean particle size of smaller than 20 μm to a temperature of over 700° C. in a reducing atmosphere to reduce the fine iron oxide powder into iron powder agglomerates with the iron particles partially sintered; after the partially sintered iron powder agglomerates cool to room temperature, a first crushing-spheroidizing process is applied to crush the iron powder agglomerates and to spheroidize the particles thereof into first iron particles having a rounded shape and a mean particle size of smaller than 20 μm; heating the first particles to an annealing temperature of 500-800° C.; after the first particles cool to room temperature, performing a second crushing-spheroidizing process to further spheroidize the first particles into second particles having a mean particle size of smaller than 20 μm, wherein the second particles have better sphericity than do the first particles, and wherein the second particles have a higher tap density and a higher compressibility than do the first particles, and wherein after a dry compaction process, the second particles have a higher green density than do the first particles.

The present invention has the following advantages:

1. The present invention, incorporating mechanical crushing processes, uses only a single chemical reaction to fabricate iron powders suitable for the MIM process and the inductor fabrication process. Therefore, the present invention is a simplified fabrication process.
2. The present invention reduces fine iron oxide powder in an ordinary sintering or reduction furnace without using the high pressure used for the carbonyl iron powder. Therefore, the present invention is an inexpensive process and is suitable for mass production.
3. The present invention further anneals the fine reduced iron powder to increase the compressibility and green density thereof and makes the fine reduced iron powder more suitable for the inductor fabrication process. The present invention further performs a second crushing-spheroidizing process to improve the sphericity of the iron particles, whereby the packing density and tap density are increased, and whereby the iron powder is more suitable for the MIM process.

DETAILED DESCRIPTION OF THE PREFERRED EMBODIMENTS

Figure 1:
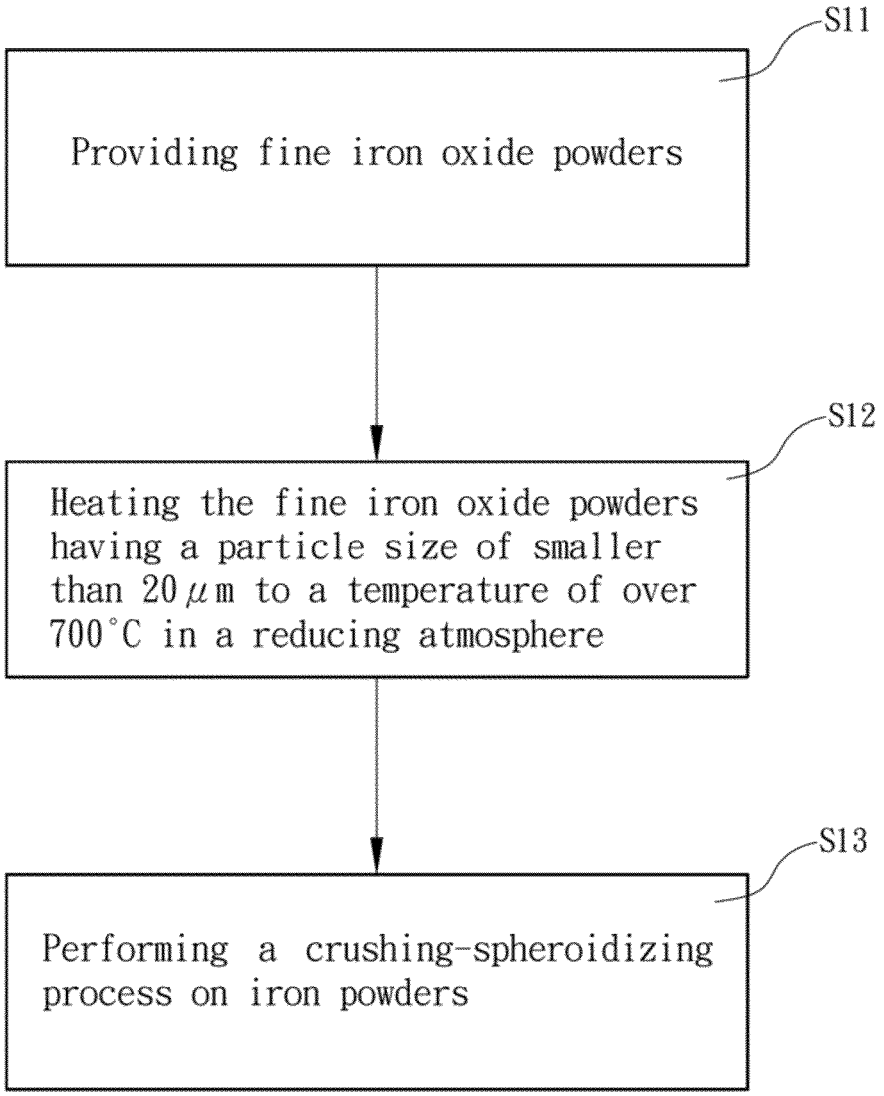
FIG. 1 is a flowchart of a method for fabricating fine reduced iron powders according to a first embodiment of the present invention.

The present invention discloses a method for fabricating fine reduced iron powders, which can produce iron powders particularly suitable for the MIM process and the inductor fabrication process. Refer to FIG. 1 showing a flowchart of a method for fabricating fine reduced iron powders according to a first embodiment of the present invention. In Step S11, provide a fine iron oxide powder containing over 98 wt % iron oxide and having a mean particle size of smaller than 20 μm. The iron oxide powder may be a powder of millscale, magnetite, hematite, or other iron oxides. In the first embodiment, the particle size of the fine iron oxide powder is preferably smaller than 10 μm. In the present invention, the fine iron oxide powder may be sourced from an iron oxide powder meeting the abovementioned specifications. Alternatively, the fine iron oxide powder is fabricated using a mechanical grinding method, such as ball milling or an equivalent method. In the first embodiment, a high-performance attritor is used to grind iron oxide powders to a mean particle size of smaller than 20 μm in a wet or dry condition.

Figure 2:
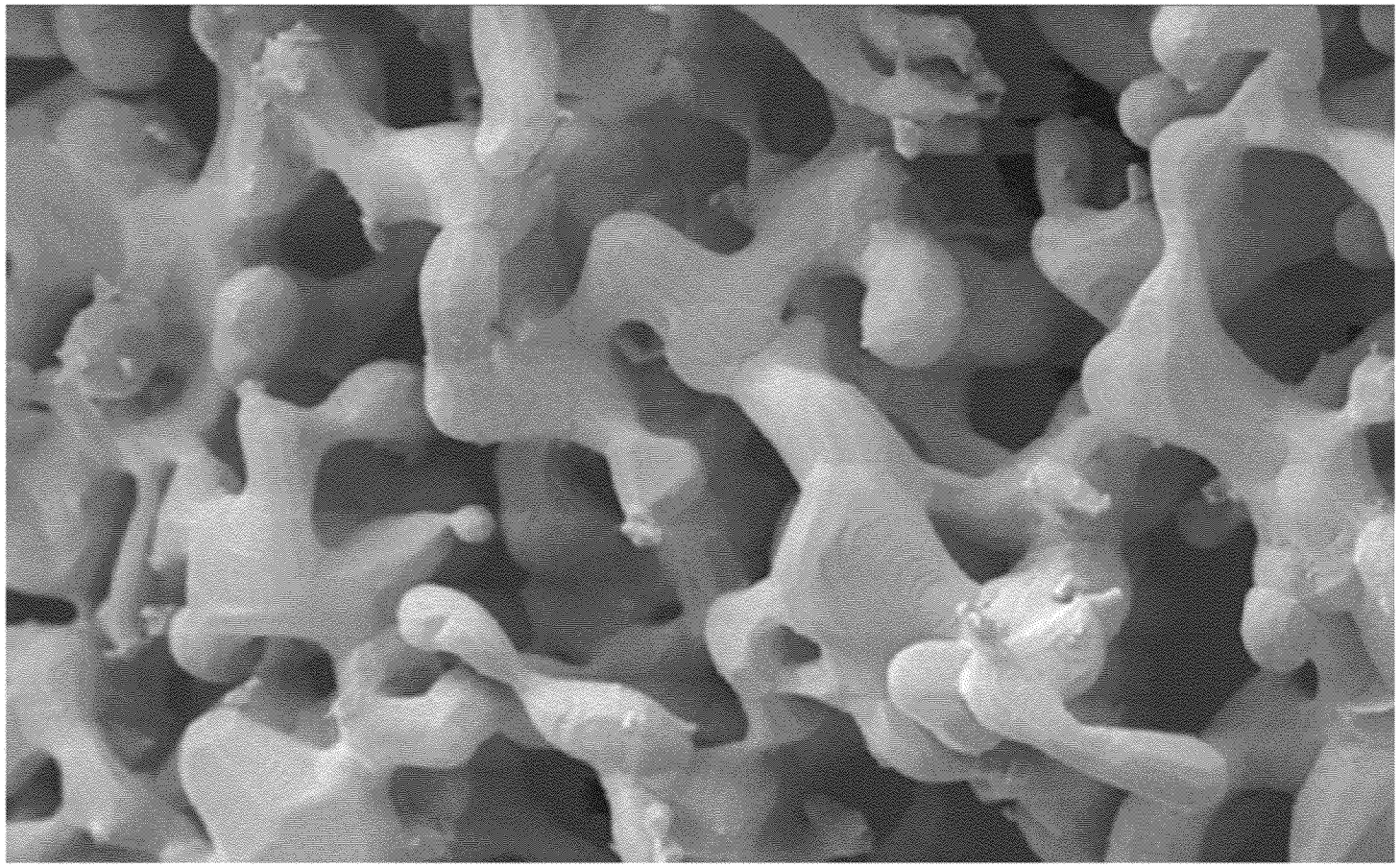
FIG. 2 is an SEM photograph of iron powders reduced from hematite powders and partially sintered.

In Step S12, heat the fine iron oxide powder to a reduction temperature and soak the fine iron oxide powder at the reduction temperature for a given period of time to reduce the iron oxide powder into iron powders. The reduction temperature must be higher than 700° C. Preferably, the reduction temperature is between 700 and 1150° C. The soaking time is between 1 and 12 hours, depending on the particle size of the iron oxide powder. In the heating and soaking processes, the fine iron oxide powder is placed in a reducing environment. In the first embodiment, the reducing environment is preferably a hydrogen atmosphere. The heating and soaking processes may be carried out using a continuous or batch-type sintering furnace. In another embodiment, the reducing environment may be an atmosphere of a gas mixture containing hydrogen or carbon monoxide, such as a gas mixture of nitrogen and carbon monoxide, a gas mixture of hydrogen, nitrogen, and carbon monoxide, or cracked ammonia. At the reduction temperature, the fine iron oxide powder is partially sintered to form iron powder agglomerates, wherein atom diffusion causes particles to bond to each other and form necks between particles. In principle, the method of the present invention controls the bonding among iron oxide particles in the initial stage of sintering, during which interparticle necks forms without much densification, as shown in FIG. 2.

After the partially-sintered iron powder agglomerates are cooled from the reduction temperature, the process proceeds to Step S13. In Step S13, perform a crushing-spheroidizing process on the partially-sintered iron powder agglomerates to break the bonding among particles, crush the partially-sintered iron powder agglomerates into individual iron powders, and spheroidize the particles. The final mean particle size is smaller than 20 μm. In the first embodiment, the partially-sintered iron powder agglomerates are crushed with an air classifier mill pulverizer (ACM). Please refer to U.S. Pat. No. 6,375,103 and U.S. Pat. No. 6,443,376 for the technology of the ACM. As the technology of the ACM is a mature prior art, it will not described here. The present invention does not limit the crushing of the partially-sintered iron powder agglomerates and the classification of the particles to being performed with an ACM. In the present invention, crushing and classification may be realized with other equipment having equivalent functions.

Figure 3:
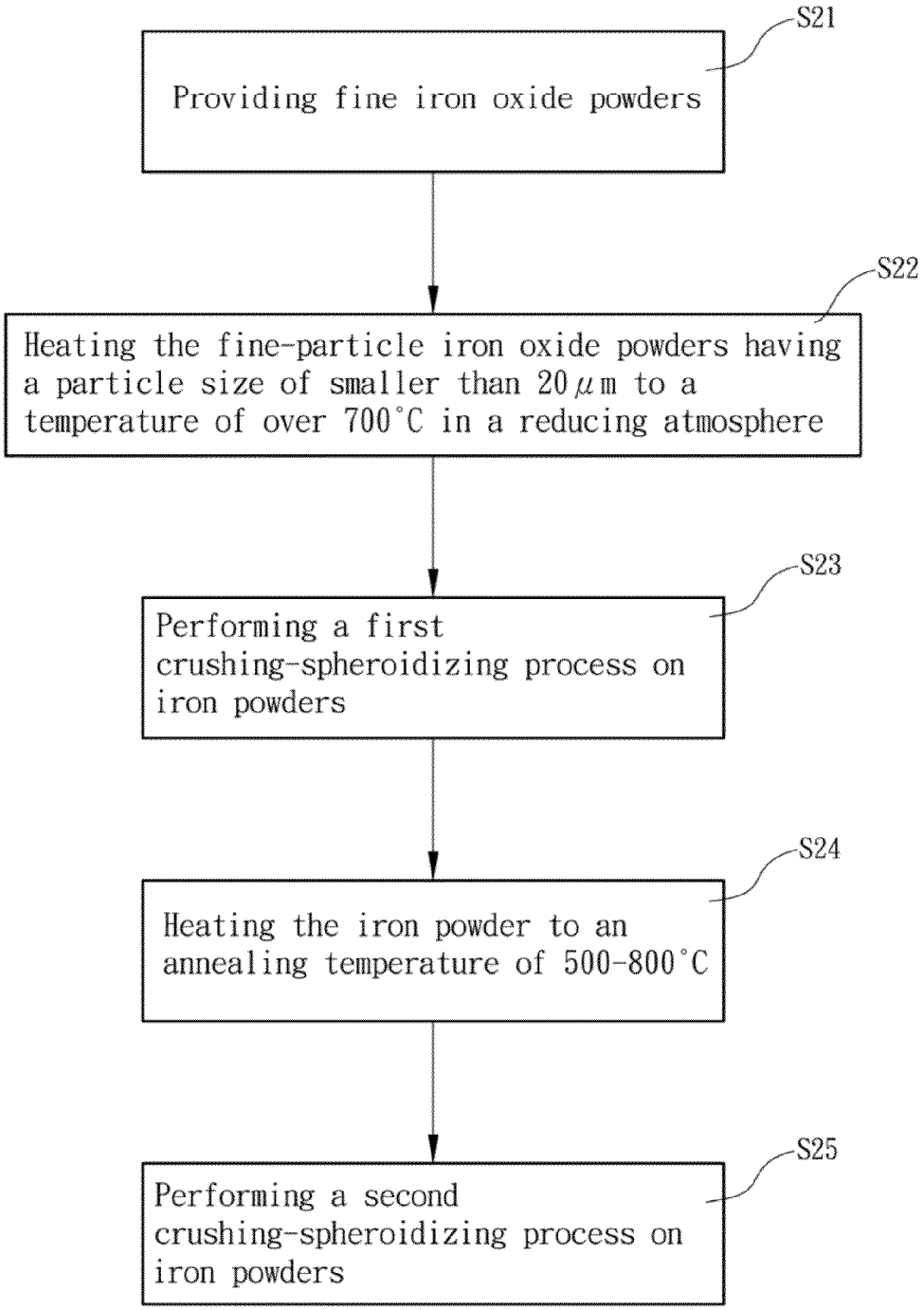
FIG. 3 is a flowchart of a method for fabricating fine reduced iron powders according to a second embodiment of the present invention.

Refer to FIG. 3 showing a flowchart of a method for fabricating fine reduced iron powders according to a second embodiment of the present invention. Step S21 and Step S22 of the second embodiment are, respectively, identical to Step S11 and Step S12 of the first embodiment. After the partially-sintered iron powder agglomerates are cooled from the reduction temperature, the process proceeds to Step S23. In Step S23, perform a first crushing-spheroidizing process on the partially-sintered iron powder agglomerates to crush the partially-sintered iron powder agglomerates into iron powders, and spheroidize the particles into first particles having a mean particle size of smaller than 20 μm. Similar to Step S13, Step S23 is also realized using an ACM. Next, the process proceeds to Step S24. In Step S24, perform an annealing process, wherein the first particles are heated to an annealing temperature of 500-800° C. and soaked at the annealing temperature for 1-6 hours. The soaking time depends on the size of the first particles. The soaking environment is a hydrogen-containing atmosphere or other reducing atmosphere. The ductility of the first particle is enhanced during the recovery stage of the annealing process. Next, the process proceeds to Step S25. In Step S25, perform a second crushing-spheroidizing process on the annealed first particles to spheroidize the annealed first particles into second particles having a mean particle size of smaller than 20 μm. The annealing process increases the plasticity and ductility of the first particles and makes the shape of the second particles closer to a sphere in the second crushing-spheroidizing process. Thus, the sphericity and tap density of the second particles are superior to those of the first particles.

Below, the method for fabricating fine reduced iron powders of the present invention is further demonstrated with more embodiments. However, these embodiments are used only for purposes of illustration of the present invention and should not be construed to limit the scope of the present invention. Table 1 shows the compositions of iron oxides used in the embodiments. A magnetite powder has Composition 1 and contains about 98.9 wt % iron oxide. A hematite powder has Composition 2 and contains over 99.5 wt % iron oxide. The magnetite powder used has two particle sizes: 4.4 μm and 6.2 μm. The hematite powder has a particle size of 0.5 μm. The fine iron oxide powders listed in Table 1 are processed according to the embodiments listed in Table 2. In Embodiments 10 and 11, annealing process and second crushing-spheroidizing process are used.

The true density of the resultant fine iron powders is measured with a pycnometer. The tap density is measured using the MPIF (Metal Powder Industries Federation) Standard 46. The mean particle size is measured using a laser particle size analyzer. An SEM (Scanning Electron Microscope) is used to examine the morphology of the resultant fine iron powders.

TABLE 1

Compositions of the iron oxides used in Embodiments (wt %)

| Composition Number | Ti | V | Mg | Al | Si | Cr | Na | Mn | Ni | O | Cu | Fe |
|---|---|---|---|---|---|---|---|---|---|---|---|---|
| 1 | 0.17 | 0.15 | 0.10 | 0.10 | 0.03 | 0.02 | 0.03 | 0.03 | 0.02 | 27.93 | — | balance |
| 2 | — | — | 0.001 | — | — | — | — | 0.19 | 0.01 | 30.69 | 0.02 | balance |

TABLE 2

Processing conditions used in Embodiments 1-11

| Embodiment Number | Composition Number | Mean Particle Size of Iron Oxide | Reduction Temperature and Time | Annealing Temperature and Time | RPM of Milling Disc | RPM of Classifier |
|---|---|---|---|---|---|---|
| 1 | 1 | 4.4 μm | 850° C., 3 hrs | — | 6980 rpm | 3570 rpm |
| 2 | 1 | 4.4 μm | 970° C., 3 hrs | — | 6980 rpm | 3570 rpm |
| 3 | 1 | 6.2 μm | 850° C., 12 hrs | — | 6980 rpm | 3570 rpm |
| 4 | 1 | 6.2 μm | 970° C., 2 hrs | — | 6980 rpm | 3570 rpm |
| 5 | 2 | 0.5 μm | 770° C., 3 hrs | — | 8380 rpm | 4170 rpm |
| 6 | 2 | 0.5 μm | 800° C., 3 hrs | — | 8380 rpm | 4170 rpm |
| 7 | 2 | 0.5 μm | 850° C., 3 hrs | — | 8380 rpm | 4170 rpm |
| 8 | 2 | 0.5 μm | 950° C., 1 hr | — | 9780 rpm | 4770 rpm |
| 9 | 2 | 0.5 μm | 700° C., 12 hrs | — | 9780 rpm | 5360 rpm |
| 10 | 2 | 0.5 μm | 850° C., 3 hrs | 650° C., 1 hr | 8380 rpm | 4170 rpm |
| 11 | 2 | 0.5 μm | 850° C., 3 hrs | 800° C., 1 hr | 8380 rpm | 4170 rpm |

TABLE 3

Characteristics of Iron Powders Obtained in Embodiments and Comparisons

| Serial Number | Composition Number | True Density | Tap Density | Particle Size |
|---|---|---|---|---|
| Embodiment 1 | 1 | 7.50 g/cm$^3$ | 2.19 g/cm$^3$ | 8.8 μm |
| Embodiment 2 | 1 | 7.59 g/cm$^3$ | 3.47 g/cm$^3$ | 11.5 μm |
| Embodiment 3 | 1 | 7.49 g/cm$^3$ | 2.97 g/cm$^3$ | 9.0 μm |
| Embodiment 4 | 1 | 7.53 g/cm$^3$ | 3.33 g/cm$^3$ | 10.3 μm |
| Embodiment 5 | 2 | 7.76 g/cm$^3$ | 3.11 g/cm$^3$ | 6.2 μm |
| Embodiment 6 | 2 | 7.67 g/cm$^3$ | 3.03 g/cm$^3$ | 6.9 μm |
| Embodiment 7 | 2 | 7.69 g/cm$^3$ | 3.11 g/cm$^3$ | 7.0 μm |
| Embodiment 8 | 2 | 7.57 g/cm$^3$ | 3.20 g/cm$^3$ | 6.0 μm |
| Embodiment 9 | 2 | 7.50 g/cm$^3$ | 3.23 g/cm$^3$ | 4.5 μm |
| Embodiment 10 | 2 | 7.68 g/cm$^3$ | 3.46 g/cm$^3$ | 6.5 μm |
| Embodiment 11 | 2 | 7.50 g/cm$^3$ | 3.48 g/cm$^3$ | 7.0 μm |
| Comparison 1 | — | 7.65 g/cm$^3$ | 3.61 g/cm$^3$ | 8.6 μm |

Embodiment 1

The magnetite powder of Composition 1, containing about 98.9 wt % iron oxide, is used in Embodiment 1. The magnetite powder is ground to a mean particle size of 4.4 μm using wet ball milling. The ground magnetite powder is placed in an aluminum oxide crucible and then placed in a hydrogen atmosphere furnace. Hydrogen is introduced into the furnace at a flow rate of 6 L/min. The ground magnetite powder is heated to a reduction temperature of 850° C. at a heating rate of 10° C./min and then soaked at the reduction temperature for 3 hours. Thus, the magnetite powder is reduced into iron powder and is partially sintered. After cooling to room temperature, the partially sintered agglomerates of the reduced iron powders are crushed and spheroidized with an ACM according to the conditions shown in Table 2 to form a reduced iron powder having a mean particle size of 8.8 μm and a tap density of 2.19 g/cm$^3$.

Embodiment 2

Embodiment 2 is basically similar to Embodiment 1, but Embodiment 2 differs from Embodiment 1 in that the reduction temperature is 970° C. Embodiment 2 yields a reduced iron powder having a mean particle size of 11.5 μm and a tap density of 3.47 g/cm$^3$.

Embodiment 3

Embodiment 3 is basically similar to Embodiment 1, but Embodiment 3 differs from Embodiment 1 in that the magnetite powder has a mean particle size of 6.2 μm and that the soaking time is 12 hours. Embodiment 3 yields a reduced iron powder having a mean particle size of 9.0 μm and a tap density of 2.97 g/cm$^3$.

Embodiment 4

Embodiment 4 is basically similar to Embodiment 3 but Embodiment 4 differs from Embodiment 3 in that the reduction temperature is 970° C. and that the soaking time is 2 hours. Embodiment 4 yields a reduced iron powder having a mean particle size of 10.3 μm and a tap density of 3.33 g/cm$^3$.

Embodiment 5

The hematite powder of Composition 2, containing over 99.5 wt % iron oxide, is used in Embodiment 5. The hematite powder has a mean average particle size of 0.5 μm. The hematite powder is placed in an aluminum oxide crucible and then placed in a hydrogen atmosphere furnace. Hydrogen is introduced into the furnace at a flow rate of 6 L/min. The hematite powder is heated to a reduction temperature of 770° C. at a heating rate of 10° C./min and then soaked at the reduction temperature for 3 hours. Thus, the hematite powder is reduced into iron powder and is partially sintered. After cooling to room temperature, the partially-sintered agglomerates of the reduced iron powders are crushed and spheroidized with an ACM according to the conditions shown in Table 2 to form a reduced iron powder having a mean particle size of 6.2 μm and a tap density of 3.11 g/cm$^3$. As hematite has a high proportion of iron oxide, the resultant reduced iron powder has a low proportion of other oxides. Therefore, Embodiment 5 can fabricate the desired iron powder without using a magnetic screening machine.

Embodiment 6

Embodiment 6 is basically similar to Embodiment 5, but Embodiment 6 differs from Embodiment 5 in that the reduction temperature is 800° C. Embodiment 6 yields a reduced iron powder having a mean particle size of 6.9 μm and a tap density of 3.03 g/cm$^3$.

Embodiment 7

Embodiment 7 is basically similar to Embodiment 5, but Embodiment 7 differs from Embodiment 5 in that the reduction temperature is 850° C. Embodiment 7 yields a reduced iron powder having a mean particle size of 7.0 μm and a tap density of 3.11 g/cm$^3$.

Embodiment 8

Embodiment 8 is basically similar to Embodiment 5, but Embodiment 8 differs from Embodiment 5 in that the reduction temperature is 950° C. and that the soaking time is 1 hours. Embodiment 8 yields a reduced iron powder having a mean particle size of 6.0 μm and a tap density of 3.20 g/cm$^3$.

Embodiment 9

Embodiment 9 is basically similar to Embodiment 5, but Embodiment 9 differs from Embodiment 5 in that the reduction temperature is 700° C. and that the soaking time is 12 hours. Embodiment 9 yields a reduced iron powder having a mean particle size of 4.5 μm and a tap density of 3.23 g/cm$^3$.

Embodiment 10

Figure 4:
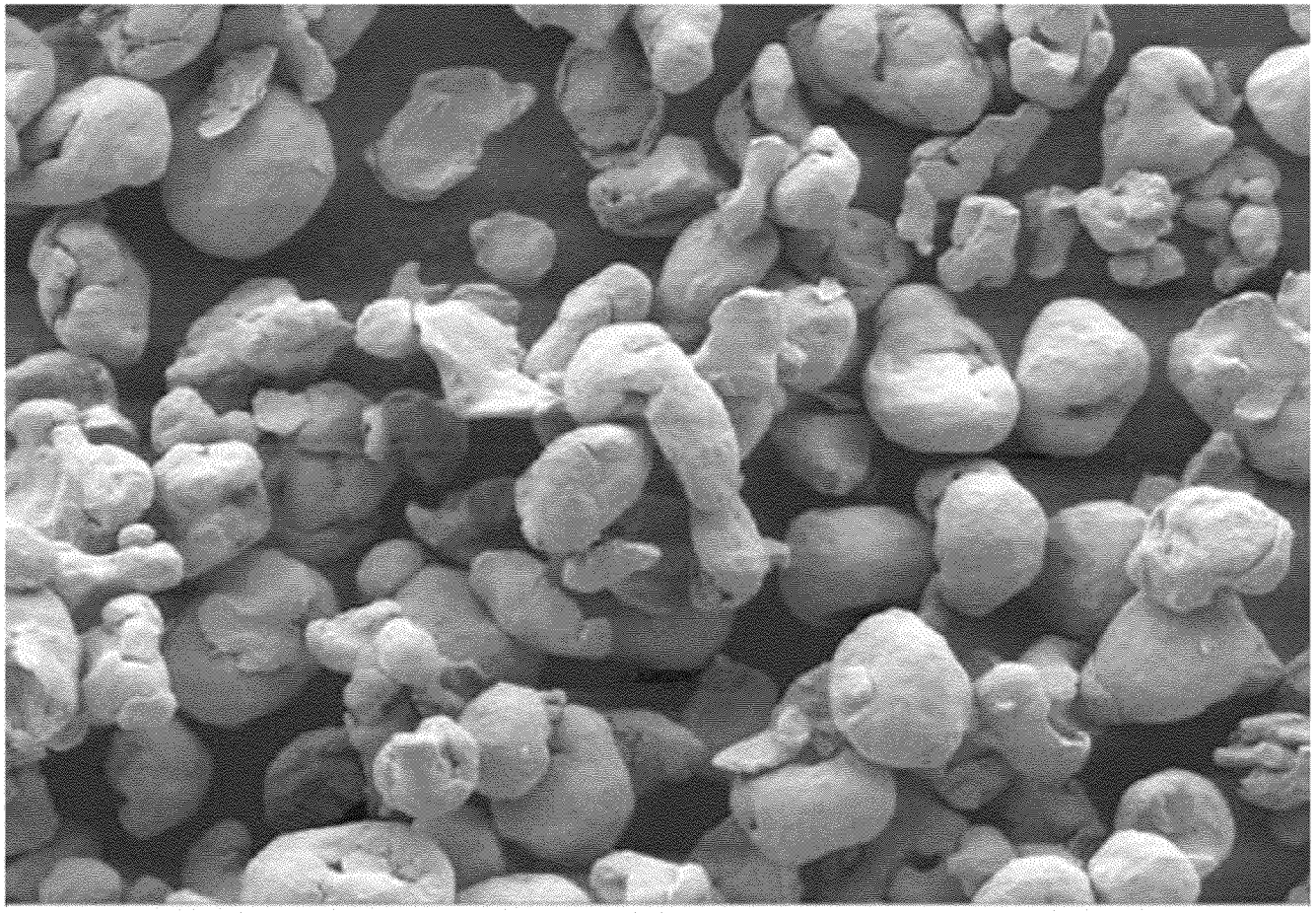
FIG. 4 is an SEM photograph of iron powders obtained in Embodiment 10.

The spheroidized reduced iron powder obtained in Embodiment 7 is annealed via heating the iron powder to a temperature of 650° C. and soaked at that temperature for 1 hour. After the annealed powder is cooled to room temperature, ACM is used to perform a second spheroidizing process on the annealed and reduced iron powder to obtain a reduced iron powder having a mean particle size of 6.5 μm and a tap density of 3.46 g/cm$^3$. The morphology thereof is shown in FIG. 4. In comparison with Embodiment 7, the annealing process and the second spheroidizing process of Embodiment 10 increase the tap density of the reduced iron powder.

Embodiment 11

Embodiment 11 is basically similar to Embodiment 10, but Embodiment 11 differs from Embodiment 10 in that the annealing temperature is 800° C. Embodiment 11 yields a reduced iron powder having a particle size of 7.0 μm and a tap density of 3.48 g/cm$^3$. In comparison with Embodiment 7, the annealing process and the second spheroidizing process of Embodiment 11 increase the tap density of the reduced iron powder.

Comparison 1

Figure 5:
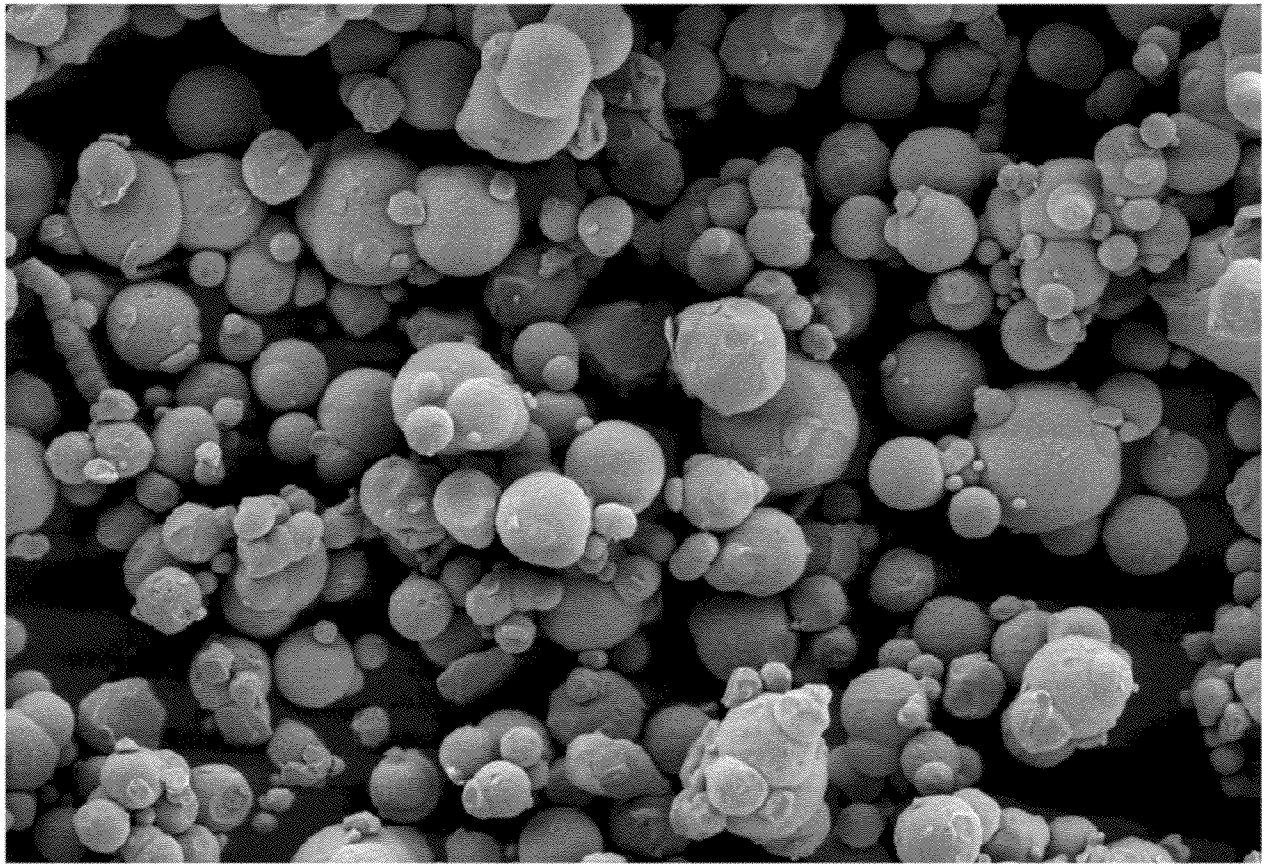
FIG. 5 is an SEM photograph of iron powder obtained in Comparison 1.

For comparison, a commercial carbonyl iron powder has a particle size of 8.6 μm and a tap density of 3.61 g/cm$^3$. The morphology is shown in FIG. 5.

In Embodiments 1-11, the tap density of the reduced iron powder can reach as high as 3.48 g/cm$^3$, and the particle size is smaller than 20 μm, and the particles have high sphericity. Therefore, the method of the present invention can fabricate reduced iron powders whose physical properties and chemical properties satisfy the requirements needed for the MIM process and the inductor fabrication process. When the fine reduced iron powder of the preset invention is used, the MIM process can produce normal sintered bodies having a relative density of over 90%.

In conclusion, the present invention proposes a method for fabricating fine reduced iron powders, wherein fine iron oxide powders are heated to a temperature higher than the sintering temperature to further reduce the iron oxide powder and to sinter the reduced iron powder slightly, and wherein the partially sintered agglomerates of the reduced iron powder are crushed and spheroidized to obtain iron powder having a high sphericity and a high tap density. Incorporating mechanical crushing-spheroidizing processes, the method of the present invention can produce iron powders suitable for the MIM process and the inductor fabrication process using a single reduction/chemical reaction. Because of the simplified process, the present invention outperforms the conventional carbonyl decomposition process, which is complicated and demands rigorous fabrication conditions and safety requirements. The method of the present invention can reduce iron oxide powders with a low-temperature reduction/sintering furnace, which is inexpensive and suitable for mass production. In the present invention, the reduced iron powder is annealed to further promote the compressibility of the iron powder. Because the annealed iron powder has higher ductility, the sphericity and the tap density of the annealed iron powder can be further increased via a second crushing-spheroidizing process. Therefore, the present invention is a clear improvement over the current technologies and is a novelty process that meets the requirements for a patent. Thus, the Inventors file the application for a patent. The present invention has been described in detail according to various embodiments. However, these embodiments are intended only to exemplify the present invention and should not be construed to limit the scope of the present invention. Any equivalent modifications or variations following the spirit of the present invention are also included within the scope of the present invention.

What is claimed is:

1. A method for fabricating fine reduced iron powder, comprising:

heating fine iron oxide powders containing over 98 weight percent iron oxide and having a mean particle size of smaller than 20 μm to a reduction temperature of over 700° C. to reduce the fine iron oxide powders in a reducing atmosphere into iron powders that are partially sintered into iron powder agglomerates; and performing a crushing-spheroidizing process on the iron powder agglomerates to crush the iron powder agglomerates into individual iron particles having a rounded shape and a mean particle of smaller than 20 μm.

2. The method for fabricating fine reduced iron powders according to claim 1, wherein the fine iron oxide powder is selected from a group consisting of millscale, magnetite, and hematite powders.

3. The method for fabricating fine reduced iron powders according to claim 1, wherein the crushing-spheroidizing process is realized with an air classifier mill pulverizer.

4. The method for fabricating fine reduced iron powders according to claim 1, wherein the fine iron oxide powder is soaked at the reduction temperature for 1-12 hours.

5. The method for fabricating fine reduced iron powders according to claim 1, wherein the reducing atmosphere contains hydrogen or carbon monoxide.

6. A method for fabricating fine reduced iron powders, comprising:

heating fine iron oxide powders containing over 98 wt percent iron oxides and having a mean particle size of smaller than 20 μm to a reduction temperature of over 700° C. to reduce the fine iron oxide powder in a reducing atmosphere into iron powders that are partially sintered into iron powder agglomerates; and performing a first crushing-spheroidizing process on the iron powder agglomerates to crush the iron powder agglomerates into first individual iron particles having a rounded shape and a mean particle size of smaller than 20 μm; and heating the first particles to an annealing temperature of 500-800° C.; and after the first particles cool to room temperature, performing a second crushing-spheroidizing process on the first particles to crush the first particles and spheroidize the first particles into second particles having a mean particle size of smaller than 20 μm and having a tap density higher than that of the first particles.

7. The method for fabricating fine reduced iron powders according to claim 6, wherein the fine iron oxide powder is selected from a group consisting of millscale, magnetite, and hematite powders.

8. The method for fabricating fine reduced iron powders according to claim 6, wherein the first crushing-spheroidizing process and the second crushing-spheroidizing process are realized with an air classifier mill pulverizer.

9. The method for fabricating fine reduced iron powders according to claim 6, wherein the fine iron oxide powder is soaked at the reduction temperature for 1-12 hours.

10. The method for fabricating fine reduced iron powders according to claim 6, wherein the reducing atmosphere contains hydrogen or carbon monoxide.

* * * * *